US005722867A

United States Patent [19]

LaGrow

[11] Patent Number: 5,722,867

[45] Date of Patent: Mar. 3, 1998

[54] REINFORCED SHOE DEVICE

[76] Inventor: Michael C. LaGrow, 3808 S. 300 East, Salt Lake City, Utah 84115

[21] Appl. No.: 546,637

[22] Filed: Oct. 23, 1995

[51] Int. Cl.[6] ..... A63C 15/06

[52] U.S. Cl. ..... 441/70

[58] Field of Search ..... 441/70, 64, 61; 280/611, 615, 616, 623, 634; 36/113, 115, 117.1, 117.2, 125

[56] References Cited

U.S. PATENT DOCUMENTS

| | | | |
|---|---|---|---|
| 2,277,538 | 3/1942 | Breeze . | |
| 2,950,487 | 8/1960 | Woods . | |
| 3,067,531 | 12/1962 | Scott et al. . | |
| 3,315,286 | 4/1967 | Brion . | |
| 3,480,978 | 12/1969 | Farmer . | |
| 4,611,414 | 9/1986 | Vogel . | |
| 4,624,646 | 11/1986 | Strohmeier | 441/70 |
| 4,981,454 | 1/1991 | Klein . | |
| 5,108,327 | 4/1992 | Klein . | |
| 5,142,798 | 9/1992 | Kaufman et al. . | |
| 5,292,272 | 3/1994 | Grim . | |

*Primary Examiner*—Stephen Avila
*Attorney, Agent, or Firm*—Thorpe, North & Western, LLP

[57] ABSTRACT

A reinforced shoe device. A shoe framework includes rigid side rails configured to reside adjacent opposing sides of the user's foot, intercoupled by at least one support rib extending upwardly from said rails so as to reside above the user's foot. An articulating toe brace is pivotally attached to the side rails and extends forwardly therefrom for supporting a front portion of the user's foot thereupon. A flexible sole is secured to the side rails, and flexible shoe walls are disposed upon the shoe framework such that the shoe walls, shoe framework and flexible sole cooperatively define an enclosure configured and dimensioned to receive at least the front portion of the user's foot thereinto. Retractable locking arms are pivotally attached to the side rails and are attachable to recreational devices such as swim fins or skis.

27 Claims, 2 Drawing Sheets

REINFORCED SHOE DEVICE

BACKGROUND OF THE INVENTION

1. The Field of the Invention

The present invention relates generally to industrial and recreational footwear. More particularly, it concerns a reinforced recreational shoe designed for walking and for attachment to recreational devices such as swim fins or skis.

2. The Background Art

Recreational activities such as snorkeling, deep sea diving and skiing require special footwear devices. However, the devices (swim fins, skis, snow shoes, work boots, etc.) are awkward for walking, prompting most users to remove them immediately after the activity in order to walk normally.

However, the user often still needs footwear protection after removing the footwear devices, such as to walk from one beach to another or to a waiting automobile. After snorkeling and deep sea diving, the swimmer must either walk with the fins on, walk barefoot, or put on shoes after removing the fins. Walking barefoot is risky, and walking while wearing the fins is extremely awkward and even dangerous because the fins are many times the area of the swimmer's foot.

It has been discovered to provide a shoe member having a retractably mounted swim fin, so that the user need not remove the fins for walking but may simply retract the fin upwardly to facilitate waling. Such devices are disclosed in U.S. Pat. Nos. 5,292,272 (issued Mar. 8, 1994 to Grim) 5,108,327 and 4,981,454 (issued Apr. 28, 1992 and Jan. 1, 1991, respectively, to Klein), and 3,480,978 (issued Dec. 2, 1969 to Farmer). Although such devices may protect the foot as opposed to walking barefoot, the shoe members to which the fins are attached are disclosed as having any particular load-bearing capacity, or any particular flexibility for walking ease.

In the case of skiing, ski boots must withstand significant forces and are therefore designed to be quite heavy and inflexible so that the user must remove the boots and put on other boots or shoes for walking. Attempts have been made to provide a ski boot assembly which may be used with a walking boot, such as that disclosed in U.S. Pat. No. 5,142,798 (issued Sep. 1, 1992 to Kaufman et al.). However, the boot itself lacks significant load-bearing capacity.

OBJECTS AND SUMMARY OF THE INVENTION

It is therefore an object of the present invention to provide a reinforced shoe device having flexible components combined with an enhanced load-bearing capacity.

It is an additional object of the invention, in accordance with one aspect thereof, to provide such a shoe device which is easier to walk in.

It is another object of the invention, in accordance with one aspect thereof, to provide such a shoe device which is attachable to other recreational foot attachments.

It is a further object of the invention, in accordance with one aspect thereof, to provide such a shoe device which enables articulating movement of an attached accessory between locked and retracted positions.

The above objects and others not specifically recited are realized in a specific illustrative embodiment of a reinforced shoe device. A shoe framework includes rigid side rails configured to reside adjacent opposing sides of the user's foot, intercoupled by at least one support rib extending upwardly from said rails so as to reside above the user's foot. An articulating toe brace is pivotally attached to the side rails and extends forwardly therefrom for supporting a front portion of the user's foot thereupon. A flexible sole is secured to the side rails, and flexible or solid shoe walls are disposed upon the shoe framework such that the shoe walls, shoe framework and flexible sole cooperatively define an enclosure configured and dimensioned to receive at least the front portion of the user's foot thereinto. The shoe device is useable for recreational or industrial purposes.

Additional objects and advantages of the invention will be set forth in the description which follows, and in part will be apparent from the description, or may be learned by the practice of the invention. The objects and advantages of the invention may be realized and obtained by means of the instruments and combinations particularly pointed out in the appended claims.

BRIEF DESCRIPTION OF THE DRAWINGS

The above and other objects, features and advantages of the invention will become apparent from a consideration of the subsequent detailed description presented in connection with the accompanying drawings in which.

DETAILED DESCRIPTION OF PRESENTLY PREFERRED EMBODIMENTS

Figure 1:
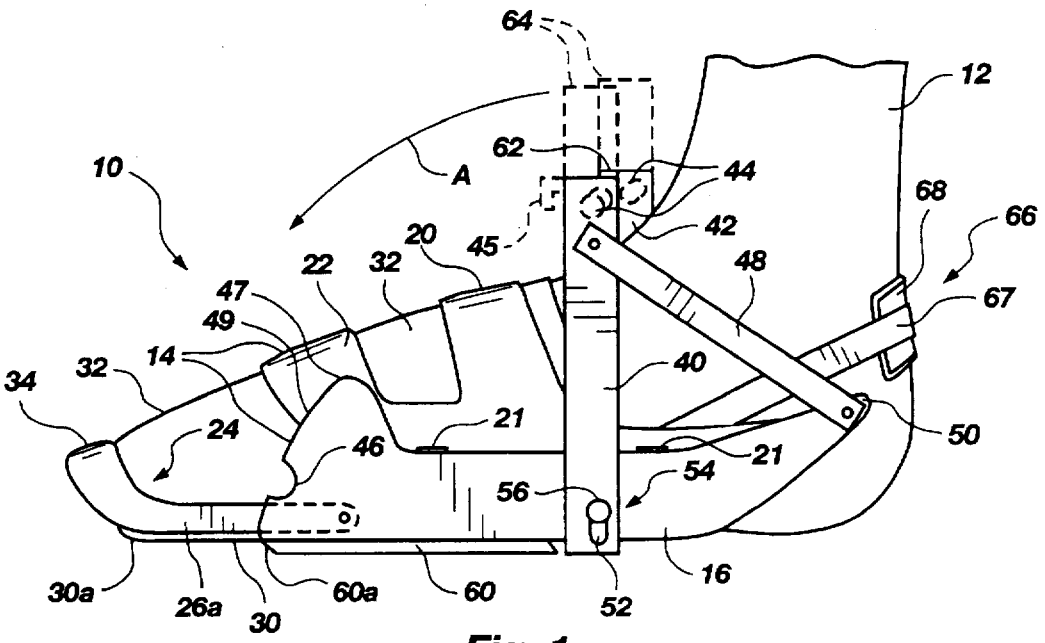
FIG. 1 is a side view of a reinforced recreational shoe device, made in accordance with the principles of the present invention and being secured to a user's foot.

For the purposes of promoting an understanding of the principles in accordance with the invention, reference will now be made to the embodiment illustrated in the drawings and specific language will be used to describe the same. It will nevertheless be understood that no limitation of the scope of the invention is thereby intended. Any alterations and further modifications of the illustrated device, and any additional applications of the principles of the invention as illustrated herein, which would normally occur to one skilled in the relevant art and possessed of this disclosure, are to be considered within the scope of the invention claimed.

Referring now to FIGS. 1–4, there is shown a reinforced recreational shoe device, generally designated at 10, secured to a user's foot 12. The shoe device 10 includes a shoe framework 14 for holding at least a front portion of the user's foot 12 therein. The framework 14 includes first and second rigid side rails 16 and 18 configured to reside adjacent opposing sides of the user's foot 12. The side rails 16 and 18 are intercoupled by at least one support rib 20, such as by welds 21, wherein the rib 20 extends upwardly from the rails so as to reside above the user's foot 12. The rails are preferably intercoupled by another support rib 22.

A flexible sole 30 is secured to the side rails 16 and 18. Flexible shoe walls 32 are disposed upon the shoe framework 14 such that the shoe walls 32, shoe framework 14 and flexible sole 30 cooperatively define an enclosure configured and dimensioned to receive at least the front portion of the user's foot 12 thereinto.

The shoe device 10 preferably includes an articulating toe brace, designated generally at 24. The toe brace 24 includes first and second rigid support arms 26*a* and 26*b* pivotally attached at 27*a* and 27*b* to the first and second side rails 16 and 18, respectively. The support arms 26*a* and 26*b* extend forwardly from the side rails 16 and 18 and are intercoupled by a toe support plate 28 configured to support a front portion of the user's foot 12 thereupon. For example, the toe support plate 28 is preferably positioned such that the ball of the foot rests thereon. The toe brace 24 is thus pivotally attached to the side rails 16 and 18. Although such pivotal attachment is preferably achieved with rivets or other suitable pivot pins, the phrase "pivotally attached" as used herein shall refer to the broad concept of a first member hingedly moveable relative to a second member in any manner, such as a living hinge element within a unibody member or some other aspect of flexibility.

If the toe brace 24 is included, a front portion of the flexible sole 30 is disposed upon the toe brace such that flexible movement of the front portion of the sole relative to the rest of the sole causes corresponding articulating movement of the toe brace relative to the side rails 16 and 18. The articulating toe brace 24 preferably includes a support rib 34 intercoupling the support arms 26*a–b* which extends upwardly from the arms so as to reside above the toe support plate 28.

Figure 4:
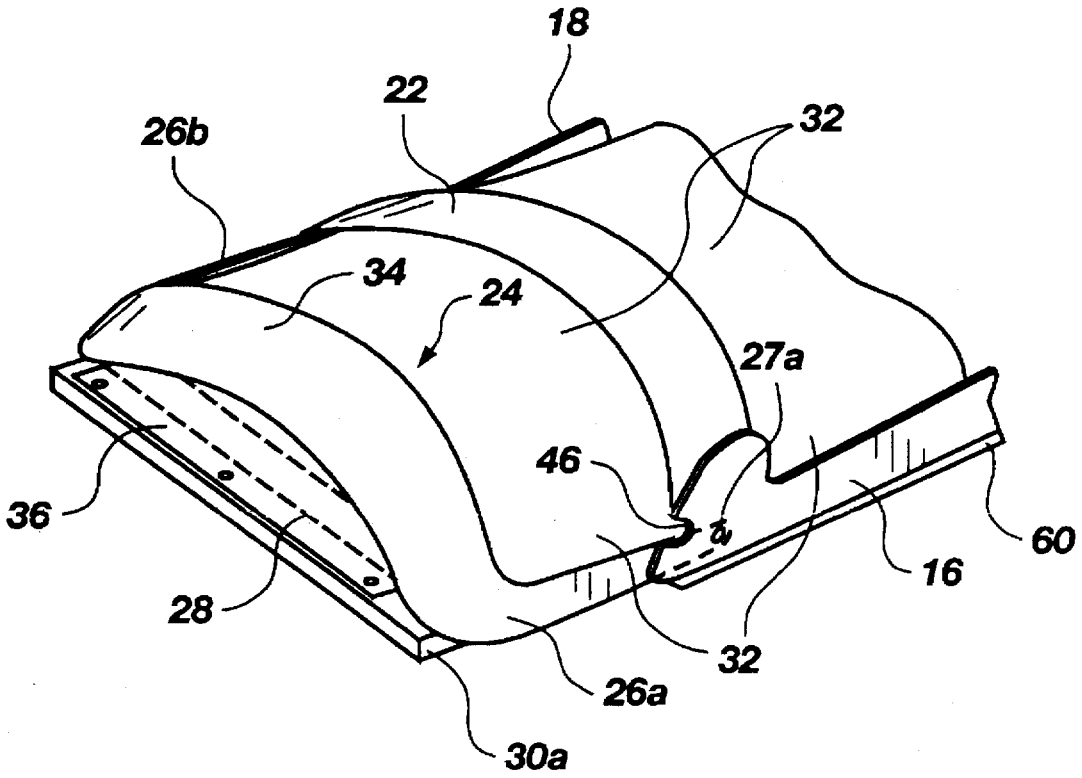
FIG. 4 is a fragmented view of a front portion of the shoe device of FIGS. 1–2, showing the sole and sliding toe plate in conjunction with the articulating toe brace.

Referring to FIG. 4, the shoe device 10 optionally but preferably also includes a sliding toe plate 36 secured to the front portion 30*a* of the flexible sole 30. The toe support plate 28 resides slidably sandwiched between the sole 30 and the sliding toe plate 36 so that flexible movement of the front portion 30*a* of the sole causes corresponding sliding movement of the sliding toe plate relative to the toe support plate. The sliding toe plate 36 preferably has more surface area than the toe support plate 28 in order to provide additional support for the foot 12 and the forces exerted thereby. A second sole layer (not shown) can be secure to the sole 30 so as to sandwich the sliding toe plate 36 and toe support plate 28 and prevent the foot from contact with those components.

Another optional but preferable aspect of the shoe device 10 is first and second retractable locking arms 40 and 42 pivotally attached to the first and second side rails 16 and 18, respectively. The locking arms 40 and 42 are configured for articulating movement between a locked position (shown in FIG. 2) and a retracted position (shown in FIG. 1) as suggested by arrow A. Each locking arm 40 and 42 includes locking means 44 for releasably locking the arm to adjacent structure (such as the side rails 16 and 18) so as to hold the arm in the locked position. As shown most clearly in FIG. 1, the locking means may include first and second knob members 44 disposed upon the first and second locking arms 40 and 42, respectively, said knob members 44 being engageable within first and second notches 46 formed in the side rails 16 and 18, respectively, in locked positions. Second locking means such as latching means 45 (shown in phantom line in FIG. 1) rigidly secured to the arms 40 and 42, may be used in addition to, or instead of, the knob members 44. Latch members 45 are configured and dimensioned to engage around distal edges 60*a* of stopping rails 60 in the locked position. Any other suitable locking means for releasably locking the arms 40 and 42 relative to the framework 14 may be used.

The side rails may include channeling means, such as rounded channeling structure 47 and cam edge 49, to contactably ease and channel the knob members 44 toward the notches 46 in a type of shoe-horn effect against the resistance of biasing means 48. In this manner, cam edge 49 is designed to gradually nudge the knob member 44 and its associated locking arm in a pivotal cam-type motion (relative to pivot pin 54) toward the notch 46, responsive to an external force applied to the locking arm propelling the arm pivotally forward toward the side rails 16 and 18 and notch 46, such as gripping and pushing by the user. The force of the biasing means 48 causes the knob member 44 to snap in place into the notch 46.

Figure 2:
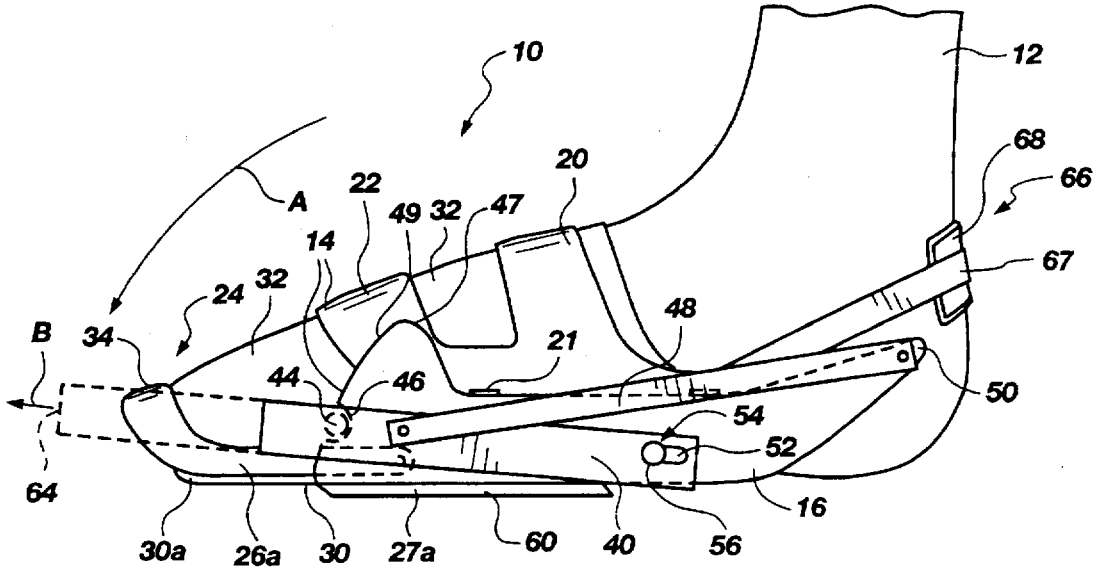
FIG. 2 is a side view of the shoe device of FIG. 1, showing the locking arm in a locked position.
Figure 3:
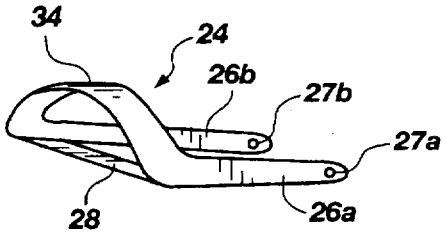
FIG. 3 is a perspective view of an articulating toe brace component of the shoe device of FIGS. 1–2.

The biasing means 48 are disposed upon the locking arms 42 and 44 for resisting forward pivotal movement of the locking arms toward the toe support plate 28, said forward pivotal movement being represented in FIGS. 1–2 by arrow A. The biasing means 48 may include, for example, two flexible rubber-like members which respectively intercouple the locking arms 42 and 44 with rear portions 50 of the side rails 16 and 18.

The pivotal attachment of the locking arms 42 and 44 to the side rails 16 and 18 is such that each locking arm includes a slot 52 formed therein. First and second pivot pins 54 respectively extend outwardly from the first and second side rails 16 and 18 and through the slots 52 of the locking arms. The pivot pins 54 terminate in retaining heads 56 which are wider than the slots 52, and the slots 52 are wider than the pivot pins 54 to enable slidable movement of the locking arms 42 and 44 relative to the side rails 16 and 18, respectively.

The shoe device 10 preferably includes stopping means 60 extending outwardly from at least one of the side rails into a movement path of the locking arm pivotally attached to said side rail, for stopping pivotal movement of said locking arm beyond the stopping means. For example, the stopping means may include dual stopping rails extending laterally outwardly from the side rails 16 and 18, as shown by FIG. 1. The locking arms 40 and 42 preferably abut the stopping rails 60 in a seated position when in the locked position as shown in FIG. 2 to enhance the strength and stability of the arms. The arms 40 and 42 may be intercoupled by a connecting piece 62 which could be secured to the toe brace 24 in any manner known to those skilled in the art, if desired, to further strengthen the shoe device 10.

In use, it will be appreciated that the pivotal, articulating nature of the toe brace 24 enables flexible displacement of the shoe device 10 which is compatible with the motions of walking feet. The shoe device 10 thus provides strong structural reinforcement in the form of shoe framework 14, but does not inhibit walking as do conventional swim fins and ski boots.

The locking arms 42 and 44 may be utilized in any useful manner. For example, the locking arms can be rigidly intercoupled by a connecting piece 62 (shown in phantom line in FIG. 1) to form a one-piece articulating locking member to which a swimming fin (not shown) could be attached. Alternatively, the locking arms themselves could be configured for attachment to any desired member represented schematically by phantom line elements 64, such as swimming fins, skis or ski bindings, snow shoes and so forth. For example, if the elements 64 represent swimming fins, a user may wear a shoe device 10 upon each foot to go snorkeling with the locking arms 42 and 44 and their attached fins secured in the lock position as in FIG. 2. The arms 42 and 44 and attached fins can be quickly snapped into the locked position of FIG. 2 by a swift kicking motion of the leg. Tension provided by the flexible bands 48 holds the arms firmly in position until the user pulls the arms outwardly in the direction of arrow B to release the knobs 44 from their locked engagement within the notches 46. The user need not remove the fins after exiting the water in order to walk, but may simply retract the locking arms 42 and 44 and their attached fins to the upwardly-projecting retracted position as in FIG. 1 so that walking movement is not impeded by the fins 64.

Other activities, such as skiing or snowshoeing, can be facilitated with the shoe device 10 in that the structural support of the shoe framework 14 can withstand the forces imposed during those activities. The locking arms 42 and 44 (or the one-piece locking member as described above) could be designed to interlock with ski bindings to enable the shoe device 10 to function as a ski boot. When the user is finished skiing, the locking arms 42 and 44 could be disengaged from the ski bindings and retracted upwardly as in FIG. 1 to enable convenient walking movement facilitated by the articulate toe brace 24 as opposed to the heavy, rigid conventional ski boots.

The shoe device 10 also includes heel engaging means 66 disposed upon the shoe framework 14 for engaging with the heel of the user's foot 12, so as to releasably retain the foot within the enclosure formed by the framework 14, shoe walls 32 and flexible sole. The heel engaging means 66 may comprise any rigid or flexible heel engaging support coupled to the shoe framework 14 for holding the heel in the shoe device 10. For example, the heel strap means 66 may include a flexible strap 67 (or an adjustable strap) which is padded for the comfort of the foot, as illustrated by pad member 68.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

What is claimed is:

1. A reinforced shoe device comprising:

a shoe framework for holding at least a front portion of a user's foot therein, including first and second rigid side rails configured to reside adjacent opposing sides of the user's foot, said side rails being intercoupled by at least one support rib extending upwardly from said rails so as to reside above the user's foot, the framework further including an articulating toe brace having first and second rigid support arms pivotally attached to the first and second side rails, respectively, said support arms extending forwardly from the side rails and being intercoupled by a toe support piece configured to support a front portion of the user's foot thereupon; and a flexible sole secured to the side rails and having a front portion disposed upon the articulating toe brace such that flexible movement of said front portion relative to the rest of the sole causes corresponding articulating movement of said toe brace relative to the side rails.

2. The shoe device as defined in claim 1, further comprising flexible shoe walls disposed upon the shoe framework such that the shoe walls, shoe framework and flexible sole cooperatively define an enclosure configured and dimensioned to receive at least the front portion of the user's foot thereinto.

3. The shoe device as defined in claim 1, wherein the articulating toe brace further comprises a second support rib intercoupling the support arms and extending upwardly therefrom so as to reside above the toe support plate.

4. The shoe device as defined in claim 1, further comprising a sliding toe plate secured to the front portion of the flexible sole, wherein the toe support plate resides slidably sandwiched between the sole and the sliding toe plate so that flexible movement of the front portion of the sole causes corresponding sliding movement of the sliding toe plate relative to the toe support plate.

5. The shoe device as defined in claim 1, further comprising:

first and second retractable locking arms pivotally attached to the first and second side rails, respectively, said locking arms being configured for articulating movement between a locked position and a retracted position, wherein each locking arm includes locking means for releasably locking the arm to adjacent structure so as to hold the arm in the locked position.

6. The shoe device as defined in claim 5, wherein the first and second side rails include first and second notches formed therein, respectively, and wherein the locking means comprises first and second knob members disposed upon the first and second locking arms, respectively, said knob members being engageable within the notches in locked positions.

7. The shoe device as defined in claim 6, wherein the pivotal attachment of the locking arms to the side rails is such that each locking arm includes a slot formed therein and first and second pivot pins respectively extend outwardly from the first and second side rails and through the slots of the locking arms, said pivot pins terminating in retaining heads which are wider than the slots, and wherein the slots are wider than the pivot pins to enable slidable movement of the locking arms relative to the side rails.

8. The shoe device as defined in claim 5, further including biasing means disposed upon the locking arms for resisting forward pivotal movement of the locking arms toward the toe support plate.

9. The shoe device as defined in claim 5, further comprising stopping means extending outwardly from at least one of the side rails into a movement path of the locking arm pivotally attached to said side rail for stopping pivotal movement of said locking arm beyond the stopping means.

10. The shoe device as defined in claim 5, wherein the first and second locking arms are rigidly intercoupled by a connecting piece to form a one-piece articulating locking member.

11. The shoe device as defined in claim 5, wherein the locking arms are configured for attachment to a member selected from the group consisting of a swimming fin or a ski.

12. The shoe device as defined in claim 1, further comprising heel engaging means disposed upon the framework for engaging with the heel of the user'foot to releasably retain the foot within the enclosure.

13. A reinforced shoe device comprising:

a shoe framework for holding at least a front portion of a user's foot therein, including first and second rigid side rails configured to reside adjacent opposing sides of the user's foot, said side rails being intercoupled by at least one support rib extending upwardly from said rails so as to reside above the user's foot;

a flexible sole secured to the side rails; and first and second retractable locking arms pivotally attached at first and second pivot points to the first and second side rails, respectively, said locking arms being configured for articulating movement between a locked position and a retracted position, wherein each locking arm includes locking means for releasably locking the arm to adjacent structure so as to hold the arm in the locked position.

14. The shoe device as defined in claim 13, further comprising flexible shoe walls disposed upon the shoe framework such that the shoe walls, shoe framework and flexible sole cooperatively define an enclosure configured and dimensioned to receive at least the front portion of the user's foot thereinto.

15. The shoe device as defined in claim 13, wherein the first and second side rails include first and second notches formed therein, respectively, and wherein the locking means comprises first and second knob members disposed upon the first and second locking arms, respectively, said knob members being engageable within the notches in locked positions.

16. The shoe device as defined in claim 15, wherein the pivotal attachment of the locking arms to the side rails is such that each locking arm includes a slot formed therein and first and second pivot pins respectively extend outwardly from the first and second side rails and through the slots of the locking arms, said pivot pins terminating in retaining heads which are wider than the slots, and wherein the slots are wider than the pivot pins to enable slidable movement of the locking arms relative to the side rails.

17. The shoe device as defined in claim 13, further including biasing means disposed upon the locking arms for resisting forward pivotal movement of the locking arms toward the toe support plate.

18. The shoe device as defined in claim 13, further comprising stopping means extending outwardly from at least one of the side rails into a movement path of the locking arm pivotally attached to said side rail for stopping pivotal movement of said locking arm beyond the stopping means.

19. The shoe device as defined in claim 13, wherein the first and second locking arms are rigidly intercoupled by a connecting piece to form a one-piece articulating locking member.

20. The shoe device as defined in claim 13, wherein the locking arms are configured for attachment to a member selected from the group consisting of a swimming fin or a ski.

21. The shoe device as defined in claim 18, wherein the stopping means includes a distal edge and wherein the locking means comprises at least one latching means rigidly secured to one of the locking arms for engaging around the distal edge of the stopping means when said at least one of the locking arms resides in the locked position.

22. The shoe device as defined in claim 13, further comprising cam means disposed on the shoe framework for gradually nudging the locking means and their associated locking arms in a cam-type motion relative to their pivot points, respectively, responsive to external force applied to the locking arms propelling said arms pivotally forward toward the side rails.

23. A reinforced shoe device comprising:

a shoe framework for holding at least a front portion of a user's foot therein, including first and second rigid side rails configured to reside adjacent opposing sides of the user's foot, said side rails being intercoupled by at least one support rib extending upwardly from said rails so as to reside above the user's foot;

a flexible sole secured to the side rails, wherein the support rib is fixedly secured with respect to the side rails and at least a portion of the flexible sole such that movement of said support rib is confined to movement in tandem with said support rails and said portion of the flexible sole; and flexible shoe walls disposed upon the shoe framework such that said flexible shoe walls are secured along at least a majority length of the support rib;

wherein the shoe walls, shoe framework and flexible sole cooperatively define an enclosure configured and dimensioned to receive at least the front portion of the user's foot thereinto such that the flexible sole resides beneath the user's foot and at least a portion of the shoe framework resides above the user's foot.

24. The shoe device as defined in claim 23, further comprising heel engaging means disposed upon the framework for engaging with the heel of the user's foot to releasably retain the foot within the enclosure.

25. A reinforced shoe device comprising:

a shoe framework for supporting at least a front portion of a user's foot;

an articulating toe brace having first and second rigid support arms pivotally attached to the shoe framework, said support arms extending forwardly from said shoe framework and being intercoupled by a toe support piece configured to support a front portion of the user's foot thereupon; and a flexible sole secured to the shoe framework and having a front portion disposed upon the articulating toe brace such that flexible movement of said front portion relative to the rest of the sole causes corresponding articulating movement of said toe brace relative to the shoe framework.

26. The shoe device as defined in claim 25, wherein the shoe framework includes first and second rigid side rails configured to reside adjacent opposing sides of the user's foot, and wherein the first and second rigid support arms of the articulating toe brace are pivotally attached to the first and second side rails, respectively, said support arms extending forwardly from the side rails.

27. A reinforced shoe device comprising:

a shoe framework for supporting at least a front portion of a user's foot;

a flexible sole secured to the shoe framework; and first and second retractable locking arms pivotally attached at first and second pivot points to the shoe framework, respectively, said locking arms being configured for articulating movement between a locked position and a retracted position, wherein each locking arm includes locking means for releasably locking the arm to adjacent structure so as to hold the arm in the locked position.

* * * * *